US007125149B2

(12) United States Patent
Kling et al.

(10) Patent No.: US 7,125,149 B2
(45) Date of Patent: Oct. 24, 2006

(54) REFLECTOR LAMP WITH REDUCED SEAL TEMPERATURE

(75) Inventors: Michael R. Kling, Lexington, KY (US); Jeffrey P. Buschmann, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 107 days.

(21) Appl. No.: 10/800,500

(22) Filed: Mar. 15, 2004

(65) Prior Publication Data

US 2005/0201105 A1 Sep. 15, 2005

(51) Int. Cl.
*F21V 7/00* (2006.01)

(52) U.S. Cl. ..... 362/348; 362/310; 362/346; 362/186; 362/345

(58) Field of Classification Search ..... 362/348, 362/345, 327, 186
See application file for complete search history.

(56) References Cited

U.S. PATENT DOCUMENTS

| | | | | |
|---|---|---|---|---|
| 4,885,668 | A * | 12/1989 | Maglica et al. | 362/345 |
| 6,053,623 | A * | 4/2000 | Jones et al. | 362/310 |
| 6,252,338 | B1 * | 6/2001 | Bergman et al. | 313/113 |
| 2001/0022727 | A1 | 9/2001 | Beaumont | |
| 2003/0193280 | A1 * | 10/2003 | Lapatovich et al. | 313/113 |

FOREIGN PATENT DOCUMENTS

| | | | |
|---|---|---|---|
| EP | 0276780 | A | 8/1988 |
| JP | 10021726 | A | 1/1998 |
| JP | 11039934 | A | 2/1999 |
| JP | 2003168303 | A | 6/2003 |
| WO | WO96/07193 | A | 3/1996 |

* cited by examiner

*Primary Examiner*—Renee Luebke
*Assistant Examiner*—Zahra I. Bennett
(74) *Attorney, Agent, or Firm*—Carlo S. Bessome

(57) ABSTRACT

A lamp assembly 10 has a light source 12 having two sealed electrodes 14, 16, sealed in a seal area 17 and defining a lamp axis 18. A concave shell 20 has an internal surface 22 with a reflective surface 23 formed thereon. The concave shell 20 has a neck 24 defining a neck cavity 26 and a reflector axis 28. The neck 24 is provided with an electrical connection 30 and a mechanical support for the light source 12. The shell 20 surrounds the source 12 to reflect light from the source 12 to a field to be illuminated during lamp operation. The source 12 and the reflector surface 23 are oriented with the lamp axis 18 substantially co-axial with the reflector axis 28, and at least a portion of at least one of the electrodes, for example, 14, extends into the neck cavity 26. A zone 32 is formed in the neck cavity 26 for substantially redirecting specular reflection away from the seal area.

4 Claims, 2 Drawing Sheets

REFLECTOR LAMP WITH REDUCED SEAL TEMPERATURE

TECHNICAL FIELD

This invention relates to electric lamps and more particularly to electric lamps enclosed in a reflector. Still more particularly, the invention relates to a parabolic reflector lamp (PAR) with a ceramic metal halide arc capsule having a reduced seal temperature.

BACKGROUND ART

Ceramic lamp envelopes with modern metal halide arc capsules have created a new class of metal halide lamp, see, for example, Geven, et al. in U.S. Pat. No. 5,424,609 and Carleton et al. in J. Ill. Eng. Soc. P139–145, Winter, 1996 (Proc. of IESNA Annual Conference). These lamps contain metal halide fill chemistries and two electrodes. A high voltage pulse between the electrodes is used to ignite the lamp. Normal current and voltage are then applied through the electrodes to excite the enclosed gas and fill materials to a plasma state. Typical fills include rare earth halides with various other additives, which can include thallium halide and calcium halide, in addition to an inert starting gas such as argon or xenon.

The ceramic arc tube is often jacketed in another envelope, called an outer jacket, to protect the inner arc tube from the atmosphere. Many of the lamp parts, especially the niobium in-leads, oxidize rapidly if exposed to air at the lamp operating temperatures, causing the lamp to fail. These outer jackets are usually thermally isolated from the arc tube by construction and contain a vacuum or are filled with a partial pressure of an inert gas and a getter material, for example, a zirconium and aluminum compound, to getter oxygen and hydrogen.

Often, the inner arc tube and outer jacket are mounted inside a parabolic reflector to gather and direct the generated light from the lamp in a useful beam pattern. This can be a flood or a spot beam for illumination of interior surfaces or building facades in exterior applications. Such lamps with halogen light sources are also commonly used for illuminating merchandise in stores and outside lighting in residential applications, for example, in security lighting. There is great interest in using ceramic metal halide lamps in the applications cited since they are efficient and provide excellent color rendering. The true colors of merchandise are rendered almost as if they were displayed in sunlight.

Economies of scale dictate using the same reflector for the new ceramic metal halide lamps (HCI lamps) as were used for halogen lamps. This keeps manufacturing costs to a minimum. It also allows the lamps to be used in existing fixtures.

Unfortunately, life tests have shown that the HCI lamps mounted in existing lamp structures fail prematurely at about 1500–200 hours, instead of progressing to their rated life expectancy of 10,00 hours. This is attributed to the rapid chemical attack by the fill material on the sealing glass (frit) used to make conventional HCI seals, (see Geven et al., supra). The problem is exacerbated when the lamps are run in the base up configuration, as they are used in many interior down-lighting applications. The seal is then subject to greater heat and therefore more active chemical reactions. To be a useful product in the markets mentioned, the lifetime of the lamp must be extended.

U.S. Published Patent Application No. 2003/0193280, published Oct. 16, 2003, and which is owned by the assignee of the instant invention, has attempted to at least partially solve the problem by interposing a light absorbing layer in the neck of the lamp, whereby extraneous light is converted to heat in the layer and then re-radiated in an unfocused manner with only a small portion of it being redirected to the seal area. The Publication suggests that the light-absorbing layer can be a black top coating on the neck interior or exterior. Alternatively, means can be provided during manufacture so that the neck portion is not metallized. While this procedure works for its intended purpose, it introduced other problems. For example, the solution is costly to implement and degrades lamp performance and appearance. The coating in the neck must be manually removed by mechanical or chemical means or, alternatively, a masking device must be incorporated into the neck area for the metallization process. Some of the light entering the neck of a normal lamp is reflected out of the lamp face and contributes to the total lumens. This light contribution is lost when the neck is made transparent. Painting the neck or using colored glass adds considerable cost to the lamp and substantially alters the appearance.

DISCLOSURE OF INVENTION

It is, therefore, an object of the invention to obviate the disadvantages of the prior art.

It is another object of the invention to enhance ceramic metal halide reflector lamps.

It is yet another object of the invention to reduce the heat delivered to the seal area of an HCI lamp during operation.

These objects are accomplished, in one aspect of the invention, by a lamp assembly comprising: a light source having two sealed electrodes sealed in a seal area and defining a lamp axis; a concave shell having an internal surface with a reflective surface formed thereon, said shell having a neck defining a neck cavity and a reflector axis, said neck being provided with an electrical connection and a mechanical support for said light source; said shell surrounding said source to reflect light from said source to a field to be illuminated during lamp operation, said source and said reflector being oriented with said lamp axis to be substantially co-axial with said reflector axis, and at least a portion of at least one of said electrodes extending in said neck cavity, and a zone formed in said neck cavity for substantially redirecting specular reflection away from said seal area.

Since it has been determined that a primary cause of the overheating of the arc tube seal is the specular reflection from the discharge that is focused on a sensitive region of the seal, the redesigned neck cross-section described above redirects this energy away from the seal and greatly increases the life of the lamp. The specular, reflection-reducing zone is easily accomplished during the envelope manufacture and involves only an inexpensive plunger change for new tooling.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
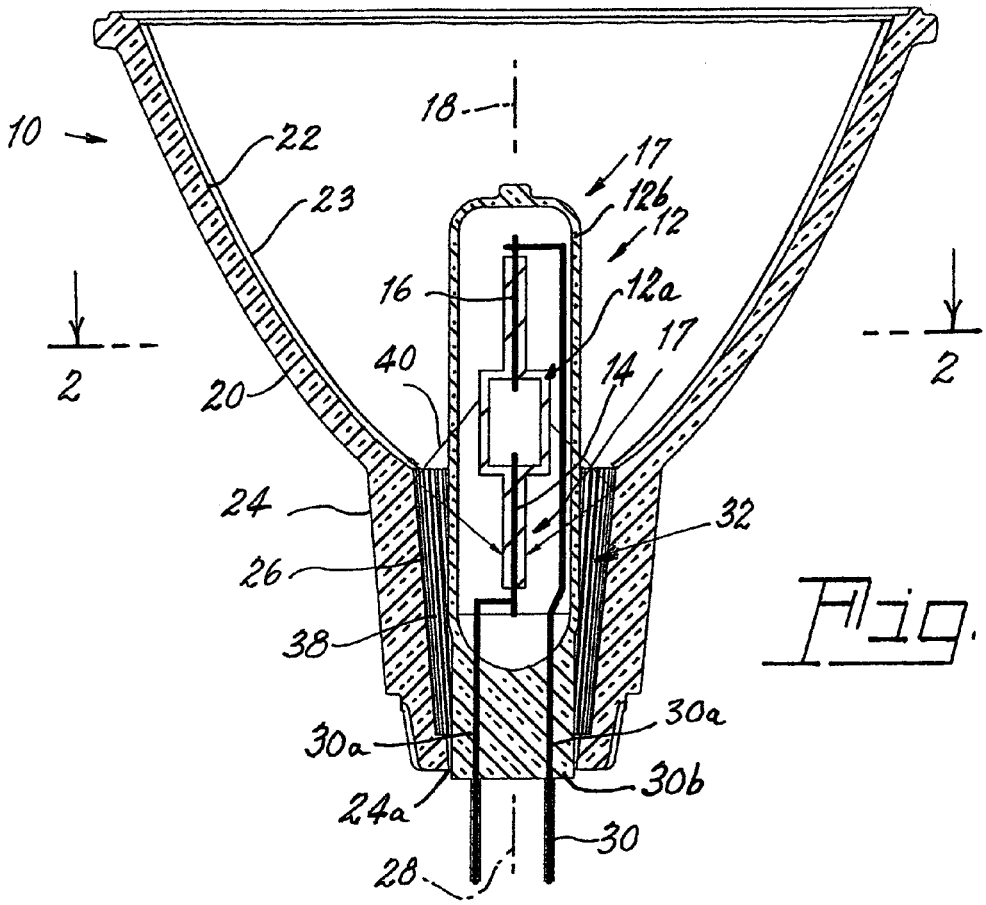
FIG. 1 is a diagrammatic cross-sectional view of a lamp embodying an aspect of the invention.

Referring now to the invention with greater particularity, there is shown in FIG. 1 a lamp assembly 10 comprising: a light source 12 including a capsule 12*a* having two sealed electrodes 14, 16, sealed in a seal area 17 and defining a lamp axis 18 and sealed in a light transmissive jacket 12*b*. A concave shell 20 has an internal surface 22 with a reflective surface 23 formed thereon. The concave shell 20 has a neck 24 with an open bottom 24*a* defining a neck cavity 26 and a reflector axis 28. The jacket 12*b* is provided with an electrical connection 30 and a mechanical support 30*a* for the capsule 12*a*. The shell 20 surrounds the source 12 to reflect light from the source 12 to a field to be illuminated during lamp operation. The source 12 and the reflector surface 23 are oriented with the lamp axis 18 to be substantially co-axial with the reflector axis 28, and at least a portion of at least one of the electrodes, for example, 14, extends into the neck cavity 26. A zone 32 is formed in the neck cavity 26 for substantially redirecting specular reflection away from the seal area. The zone 32 terminates adjacent the open bottom 24*a* and an end 30*b* of the light transmissive jacket 12*a* is positioned in the oven bottom 24*a* and fixed therein.

Figure 2:
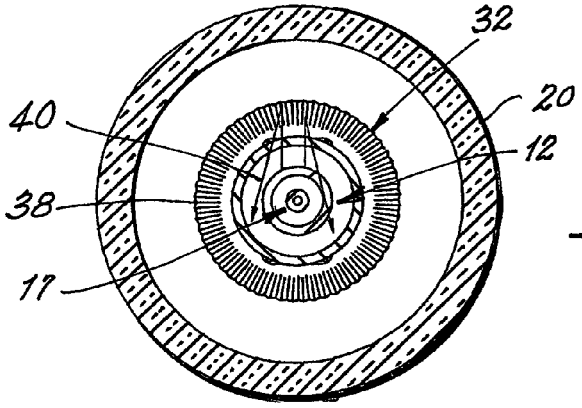
FIG. 2 is a cross-sectional plan view taken along the line 2—2 of FIG. 1.

In a preferred embodiment of the invention, as shown in FIGS. 1 and 2, the zone 32 formed in neck cavity 26 is provided with a plurality of longitudinal grooves 38. The arrows 40 indicate how the light is redirected away from the seal area 17.

Figure 3:
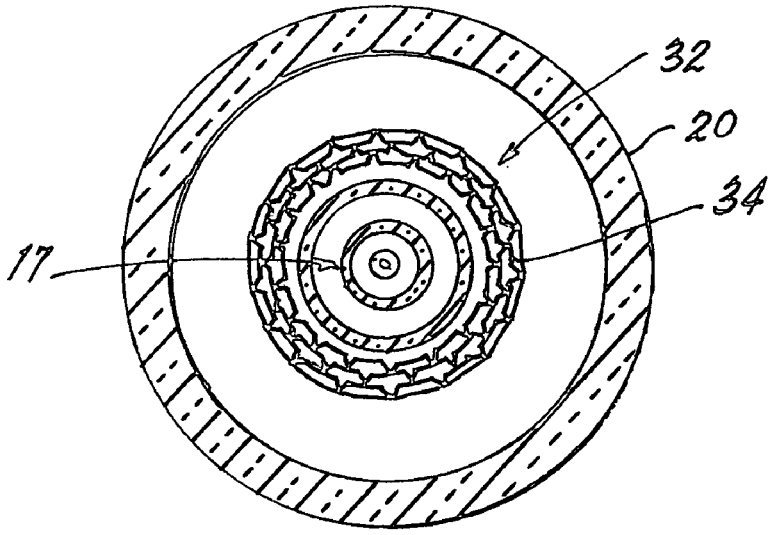
FIG. 3 is a cross-sectional plan view similar to FIG. 2 showing an alternate embodiment.
Figure 4:
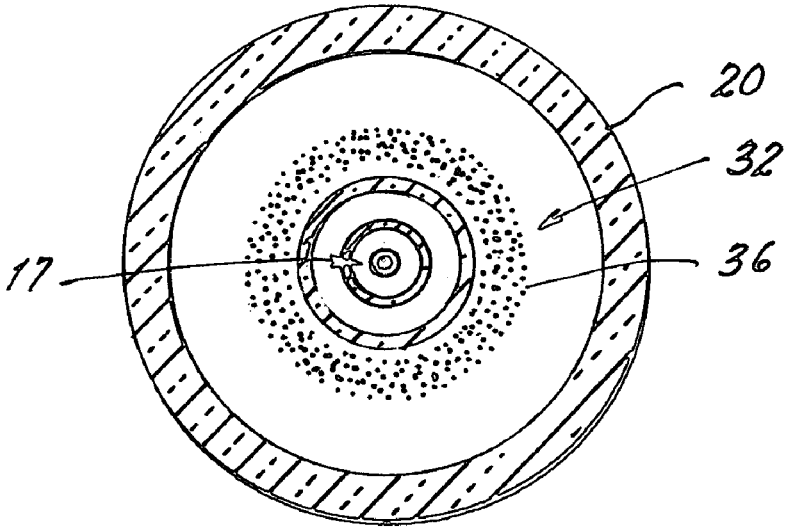
FIG. 4 is a similar view showing yet another alternate embodiment.

FIGS. 3 and 4 illustrate alternate embodiments wherein the neck cavity 26 can be provided with facets 34 or can be stippled, as at 36.

Providing the neck region with the zone formed to redirect the specular reflections away from the seal area 17 reduces the heat delivered to the seal area and greatly enhances the life of the arc tube.

It is very cost effective since any of the appropriate forms of redirection can be applied when the envelope is manufactured.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A lamp assembly comprising:

a light source including a capsule having two sealed electrodes sealed in a seal area and defining a lamp axis, said capsule being sealed in a light transmissive jacket;

a concave shell having an internal surface with a reflective surface formed thereon, said shell having a neck defining a neck cavity with an open bottom and a reflector axis, said jacket being provided with an electrical connection and a mechanical support for said light source;

said shell surrounding said source to reflect light from said source to a field to be illuminated during lamp operation, said source and said reflector being oriented with said lamp axis to be substantially co-axial with said reflector axis, and at least a portion of at least one of said electrodes extending in said neck cavity; and a zone formed in said neck cavity for substantially redirecting specular reflection away from said seal area, said zone terminating adjacent said open bottom, and an end of said light transmissive jacket being positioned in said open bottom.

2. The lamp assembly of claim 1 wherein said zone comprises a plurality of facets arrayed about the surface of neck cavity.

3. The lamp assembly of claim 1 wherein said zone comprises a stippled pattern arrayed about the surface of said neck cavity.

4. The lamp assembly of claim 1 wherein said zone comprises a plurality of closely spaced longitudinal grooves arrayed about the surface of said neck cavity.

* * * * *